US008047038B2

(12) United States Patent
Owens, IV

(10) Patent No.: US 8,047,038 B2
(45) Date of Patent: Nov. 1, 2011

(54) FLASHING BENDER

(76) Inventor: John D. Owens, IV, Waterville, ME (US)

( * ) Notice: Subject to any disclaimer, the term of this patent is extended or adjusted under 35 U.S.C. 154(b) by 520 days.

(21) Appl. No.: 12/323,658

(22) Filed: Nov. 26, 2008

(65) Prior Publication Data

US 2010/0126247 A1 May 27, 2010

(51) Int. Cl.
*B21C 3/02* (2006.01)
*E04F 21/00* (2006.01)

(52) U.S. Cl. ..... 72/176; 72/274; 72/468

(58) Field of Classification Search ..... 72/176, 72/274, 278, 291, 467, 468, 476, 477
See application file for complete search history.

(56) References Cited

U.S. PATENT DOCUMENTS 2,716,805 A * 9/1955 Reed ..... 72/467
2,800,818 A 7/1957 Larson
3,495,506 A * 2/1970 Plymale ..... 72/468
3,895,467 A 7/1975 Clement
4,148,205 A * 4/1979 Boysen ..... 72/176
5,024,076 A 6/1991 Warner
5,199,294 A 4/1993 Murczek
5,836,198 A 11/1998 Guilford
6,176,064 B1 1/2001 Janelle
6,681,613 B1 1/2004 English
6,845,648 B1 1/2005 English
7,111,485 B1 9/2006 Fiore

* cited by examiner

*Primary Examiner* — David Jones
(74) *Attorney, Agent, or Firm* — Verrill Dana, LLP; Chris A. Caseiro

(57) ABSTRACT

A flashing bender system for bending flashing at a selectable range of angles. The flashing bender system includes a first bending tool and a second bending tool. The first bending tool is arranged to bend flashing to an angle of about 90° and the second bending tool is arranged to bend flashing at a selectable range of pitches. The flashing bender system may include either or both of the first bending tool and the second bending tool. The flashing bender system allows a user to bend flashing of a range of sizes at a range of angles over an unlimited length. Each of the bending tools includes a plurality of starter slots and angling channels.

11 Claims, 4 Drawing Sheets

FLASHING BENDER

BACKGROUND OF THE INVENTION

1. Field of the Invention

The present invention relates to devices for converting flat items into angled items. More particularly, the present invention relates to devices for bending flat metallic pieces into angled pieces. The present invention relates to flashing bender devices.

2. Description of the Prior Art

Those involved in construction regularly deal with interfaces between adjacent structures. Those adjacent structures may be fabricated of the same or dissimilar materials. Particularly for external surfaces, those interfaces must be sealed to protect against environmental conditions. Examples of such interfaces include, but are not limited to, chimney-to-roofing interfaces and roofing-to-fascia interfaces, to name just two examples. Of course, there are many other structural interfaces that must be enclosed in some manner.

A common mechanism for sealing structural interfaces of the type described is to apply flashing over the interface. The flashing is arranged to extend partially over each of the adjacent structures and may be centered on the interface itself. The flashing not only seals the interface, it also acts to reinforce the interface. Generally stated, flashing is a thin impervious material placed in construction (e.g., in mortar joints and through air spaces in masonry) to prevent water penetration and/or to provide water drainage, such as between a roof and wall, between a roof and a chimney, and over exterior door openings and windows. The material is capable of being bent and retaining the general shape of the bend created.

By its function, flashing must be angled to fit over an interface. The required flashing angle can vary as a function of the particular application and interface configuration. The required length of the two legs of the angled flashing can also vary as a function of the particular application and interface configuration. For these reasons, it is often unreasonable to purchase flashing pre-fabricated for all conditions. As a result, flat sheets of flashing material are obtained for a project. The flashing sheets are ordinarily formed into selectable angles on site. It is the process of converting the flat sheets into angled flashing that can be a time consuming task. Further, the created angles may be off enough to require further modification of the formed sheet as it is applied to the interface. The difficulties associated with flashing manipulation can increase the cost of the project. It is a desirable goal in construction to form flashing more efficiently.

A number of tools have been created to assist in the shaping (generally referred to as bending) of flat flashing pieces into angled flashing. These benders may also be referred to as brakes. One type of bender is an automated or machine-assisted bender. The automated bender is expensive, subject to maintenance requirements and setup delays. Moreover, some automated flashing benders or brakes may be limited as to the length of flashing that they can bend. Some manual tools are available, but they fail to address the need to bend at an array of angles for an array of flashing sizes, including 8", 6", 4.5" and 5"×7" roofing flashing (also referred to as step flashing). They too may have limitations on the length of flashing that can be angled.

Each of the prior flashing benders described has a limitation. They are either too expensive, too time consuming to operate, difficult for a single person to operate or insufficient to bend flashing of all desired angles and all desired flashing sizes. Therefore, what is needed is a flashing bender that is easy for a single person to use. Further, what is needed is a cost effective bender. Also, what is needed is a flashing bender that is adaptable for use to bend flashing to a plurality of selectable angles for a range of flashing sizes and lengths.

SUMMARY OF THE INVENTION

It is an object of the present invention to provide a flashing bender that is adaptable for use to bend flashing to a plurality of selectable angles for a range of flashing sizes and lengths. It is also an object of the present invention to provide such a flashing bender that is inexpensive and easy for a single person to use.

These and other objects are achieved with the present invention, which is a flashing bender system including either or both of a first bending tool and a second bending tool. Each of the two bending tools includes a plurality of bending slots. The two tools of the flashing bender system of the present invention are hand held and can be used by a single person to bend flashing material to a desired angle. They accommodate flashing of different sizes and have a complete pass through arrangement that allows the user to bend flashing of any desirable length. As a result, a single flashing may be formed to cover a long interface. Prior flashing brakes were limited to bending flashing of only a maximum of 12 feet in length. As a result, a user would have one or more flashing seams, which could be exposed to the environment. The present system allows the bending of very long lengths of flashing that eliminate the need to have gaps or seams. Each of the tools includes a plurality of bend starter slots, with the particular starter slot selected based on the particular length flashing to bend.

The leading edge of a flat piece of flashing is inserted into a selected starter slot and then bent upwardly to touch a contact side of the tool to produce a crimp corner in the piece. The piece is then removed from the starter slot and a left edge is inserted into a selected one of a plurality of angling channels of the tool. The angling channel is selected based upon the desired pitch of the final angled flashing. The crimped corner of the piece is then inserted into a corner of a primary channel of the tool. The second leg of the piece, the one first created at the leading edge of the piece when placed in contact with the contact side, is directed into the primary channel. Once the piece is positioned in one of the angling channels and in the primary channel, it can be pulled through the tool for its entire length. Once pulled completely through the tool, the flashing is angled at a desired angle with desired angle leg lengths.

One of the two bending tools of the system of the present invention is arranged to form flashing at a 90° angle. This particular tool includes starter slots and angling channels for 8", 6" and 4.5" flashing, and for 5"×7" step flashing, such as used at a roof interface. The other of the two bending tools includes starter slots for 8", 6" and 4.5" flashing. It also includes angling channels for such flashing sizes and those angling channels are arranged to allow the user to select from the range of 1×12 to 12×12 pitch angles for the flashing.

The flashing bender system of the present invention is suitable for manual formation of angled flashing of desired angle, size and length. It is cost effective and capable of use by a single individual. These and other advantages of the present invention will become apparent upon review of the following detailed description, the accompanying drawings and the appended claims.

DETAILED DESCRIPTION OF THE PREFERRED EMBODIMENT

A flashing bender system of the present invention is shown in FIGS. 1-4. The flashing bender system includes a first bending tool 10 shown in FIG. 1, and a second bending tool 100, shown in various configurations in FIGS. 2-4. The flashing bender system may include either or both of the first bending tool 10 and the second bending tool 100. The flashing bender system allows a user to bend flashing of a range of sizes at a range of angles over an unlimited length. The flashing bender system is a low cost system that allows a single user efficiently and accurately bend flashing on site.

Figure 1:
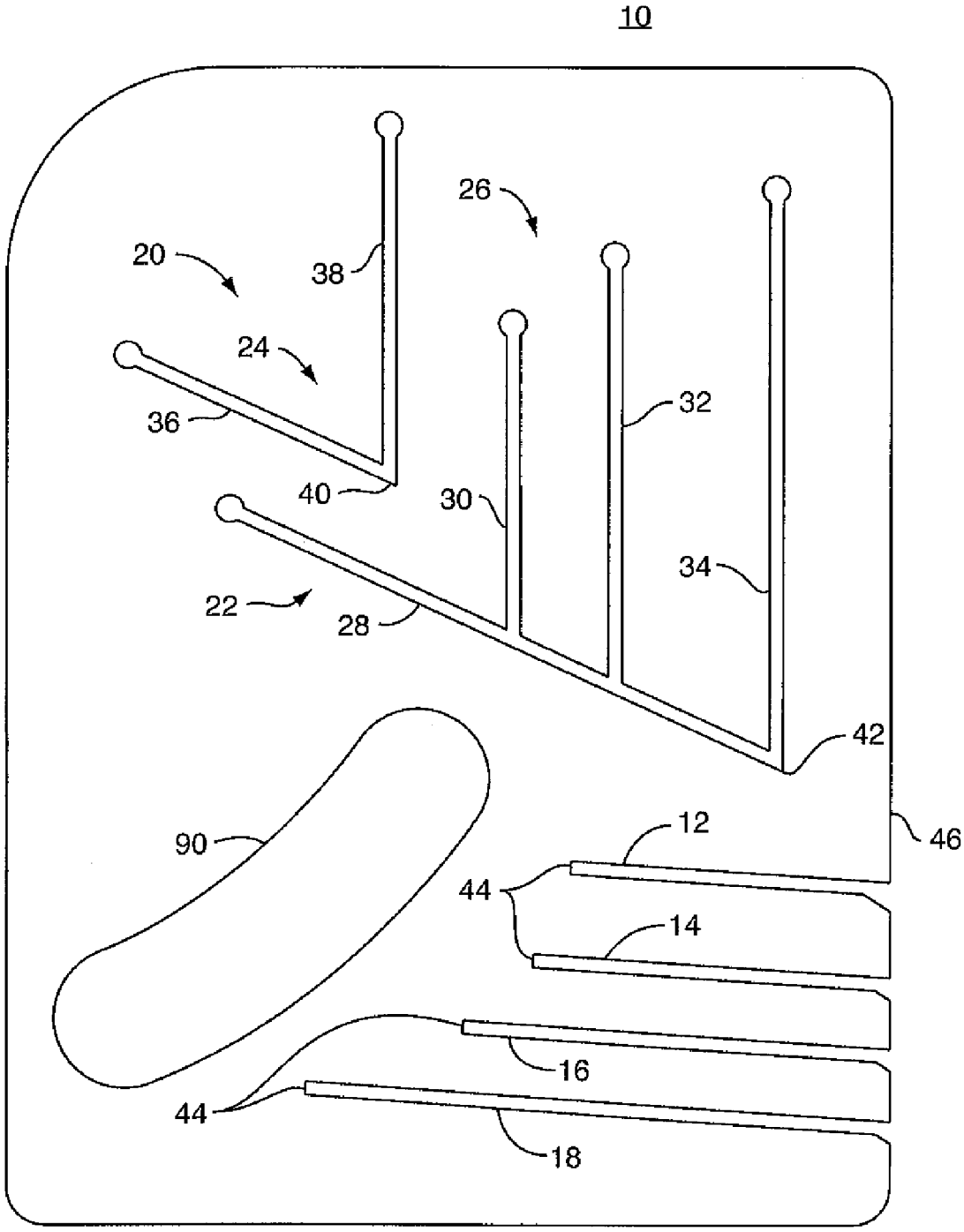
FIG. 1 is a plan view of a first bending tool of the flashing bender system of the present invention.

With reference to FIG. 1, the first bending tool 10 is a plate or other form of solid structure that may be fabricated of metallic or nonmetallic material. For example, the first bending tool 10 may be fabricated of a high-strength plastic material, such as nylon, but not limited thereto. The first bending tool 10 is made of a material suitable for forming or machining slots, ports, holes and the like therein from a first surface through to a second surface. The first bending tool 10 may optionally include a hand port 90 configured to allow a user to grasp securely the first bending tool 10 when flashing is pulled therethrough. The first bending tool 10 is configured to bend flashing such that the resultant angle of the bent flashing is about 90°.

The first bending tool 10 includes bend starter slots 12, 14, 16 and 18. Starter slot 12 is used for 4.5" flashing, starter slot 14 is used for 5"×7" step flashing, starter slot 16 is used for 6" flashing, and starter slot 18 is used for 8" flashing. The starter slots 12-18 may be cut into or molded into and through the first bending tool 10 plate and may be slightly angled but are not required to be angled.

The first bending tool 10 also includes a first angling section 20 and a second angling section 22. The first angling section 20 includes angling channel 24 configured to enable the forming a 90° angle in 5'×7" step flashing. The second angling section 22 includes angling array 26 configured to enable the forming of a 90° angle in any one or more of 8", 6" and 4.5" flashing. Specifically, angling array 26 includes a primary channel 28, a first flashing size channel 30, a second flashing size channel 32 and a third flashing size channel 34. First flashing channel 30 is used for 4.5" flashing, second flashing channel 32 is used for 6" flashing, and third flashing channel 34 is used for 8" flashing. The angling channel 24, the primary channel 28 and the flashing size channels 30-34 may be cut into or molded into and through the first bending tool 10 plate.

The angling channel 24 includes first angle slot 36 and second angle slot 38. The first angle slot 36 and the second angle slot 38 are arranged with respect to one another such that the interior angle they form at vertex 40 is less than 90°. This is necessary to accommodate the relaxation of 5'×7" step flashing that is drawn through the angling channel 24 as described herein. That is, when the flashing exits the first bending tool 10 after being pulled through, the angle that its two legs form is about 90°. For the same reason, the angling array 26 is arranged so that the interior angle formed at vertex 42 of the intersection of the primary channel 28 and any of the flashing size channels 30-32 is less than 90°.

In use, a person interested in bending flashing to an angle of about 90° coming out of the first bending tool 10, inserts the leading edge of a flat piece of flashing into the starter slot 12-18 corresponding to the flashing size of interest until the flashing abuts terminal end 44 and bends the piece upwardly to contact tool side 46. That produces a crimp in a corner of the flashing piece about midway along the flashing width. The flashing piece is then removed from the starter slot selected.

Upon removal from the selected one of the starter slots 12-18, the user then inserts an edge thereof into first angle slot 36 of angling channel 24 if the flashing to be bent is 5"×7" step flashing, or into primary channel 28 if any other flashing size is to be bent. The originating crimp is then inserted into the corner associated with either of vertex 40 or 42 such that a first "leg" of the flashing piece is located in the first angle slot 36 or the primary channel 28. The second "leg" of the flashing piece, the one that was created at the leading edge by contacting contact side 46, is directed into second angle slot 38 to bend the 5"×7" step flashing or into a selected one of flashing channels 30-34, dependent upon flashing size. Once the piece is positioned in the identified slots or channels, the user pulls it through the first bending tool 10 for the entire selectable length of the piece. The piece produced is flashing arranged through its entire length at substantially a 90° angle.

Figure 2:
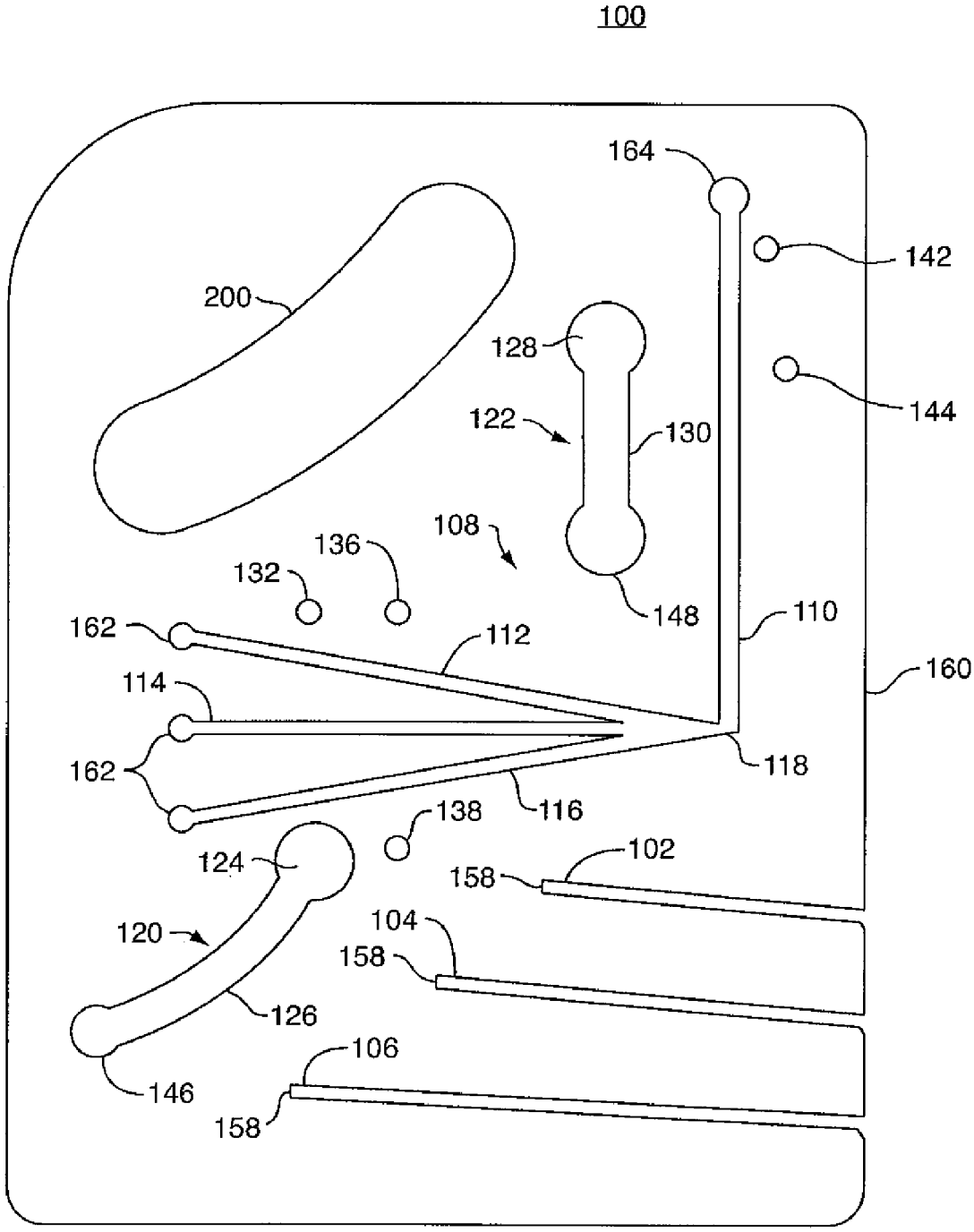
FIG. 2 is a plan view of a second bending tool of the flashing bender system of the present invention, showing an arrangement for bending 8" flashing.
Figure 3:
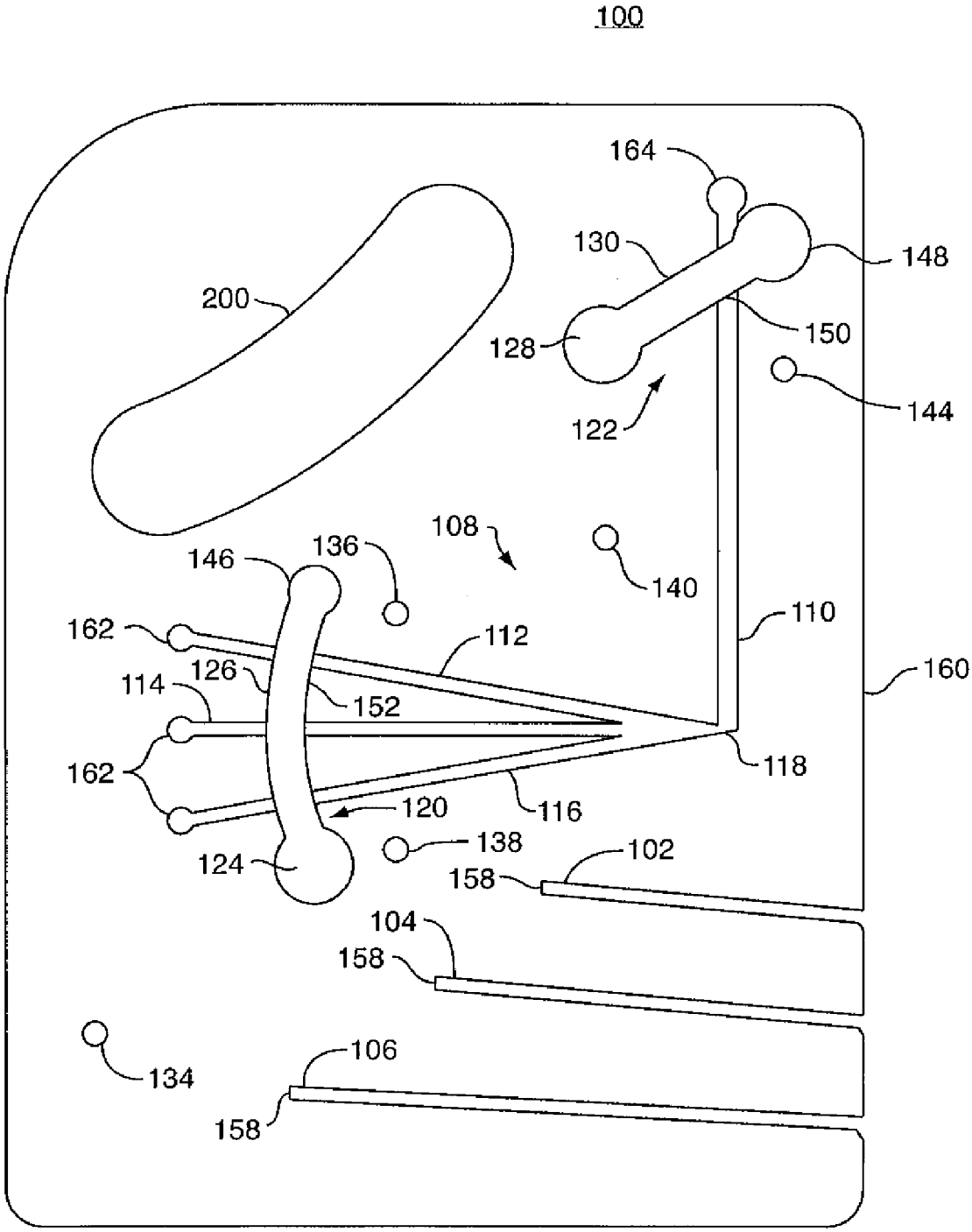
FIG. 3 is a plan view of the second bending tool of the flashing bender system of the present invention, showing an arrangement for bending 6" flashing.
Figure 4:
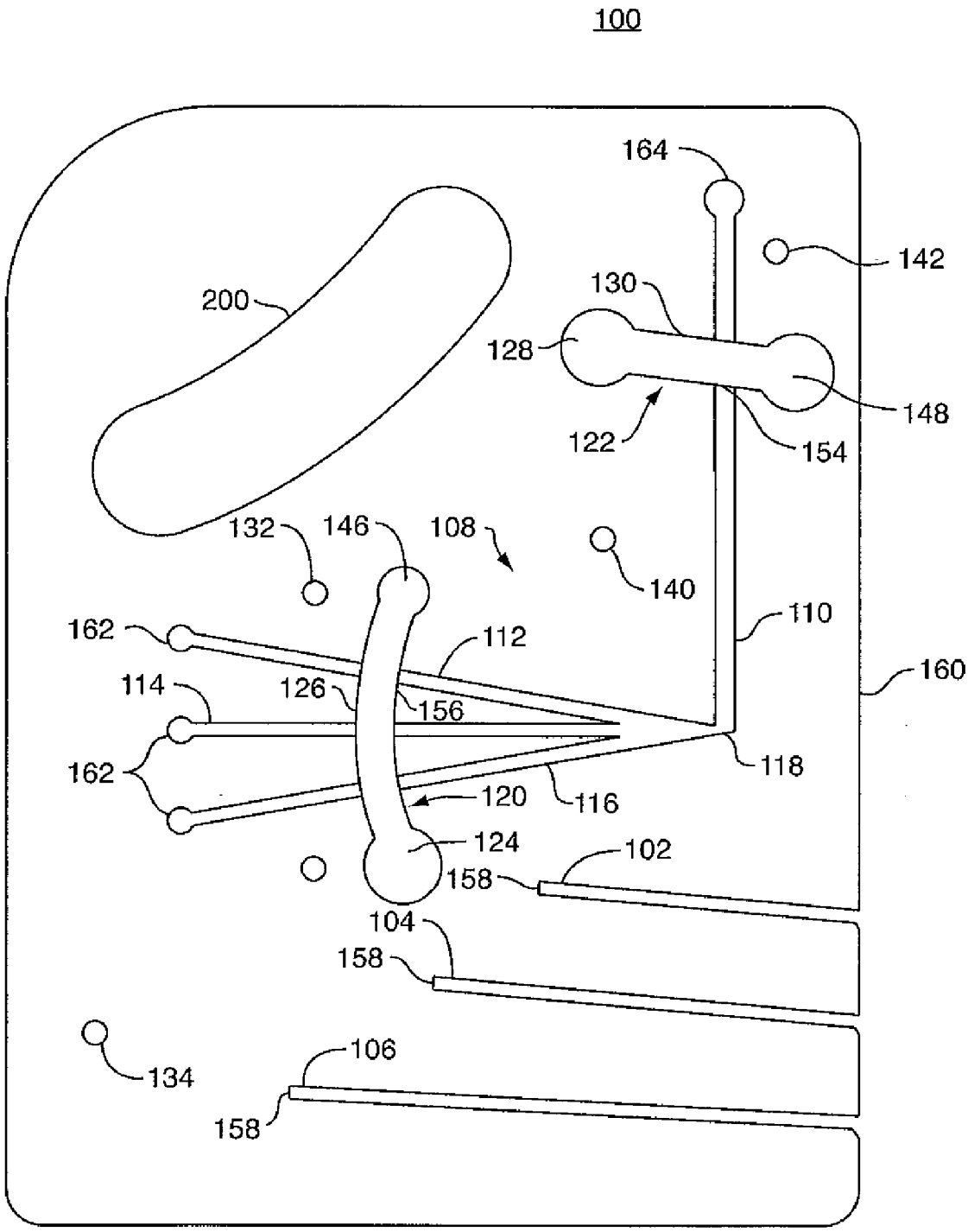
FIG. 4 is a plan view of the second bending tool of the flashing bender system of the present invention, showing an arrangement for bending 4.5" flashing.

With reference to FIGS. 2-4, the second bending tool 100 is a plate or other form of solid structure that may be fabricated of metallic or nonmetallic material. For example, the second bending tool 100 may be fabricated of a high-strength plastic material, such as nylon, but not limited thereto. The second bending tool 100 is made of a material suitable for forming or machining slots, ports, holes and the like therein from a first surface through to a second surface. The second bending tool 100 is configured to bend flashing such that the resultant angle of the bent flashing is selectable for any whole number pitch between 1×12 and 12×12. The second bending tool 100 may optionally include a hand port 200 configured to allow a user to grasp securely the second bending tool 100 when flashing is pulled therethrough.

The second bending tool 100 includes bend starter slots 102, 104 and 106. Starter slot 102 is used for 4.5" flashing, starter slot 104 is used for 6" flashing, and starter slot 106 is used for 8" flashing. The starter slots 102-106 may be cut into or molded into and through the second bending tool 100 plate.

The second bending tool 100 also includes angling channel 108 configured to enable the forming of selectable flashing pitch angles in any one or more of 8", 6" and 4.5" flashing. Angling channel 108 includes a primary channel 110, a first angle set channel 112, a second angle set channel 114 and a third angle set channel 116. First angle set channel 112 is used for any flashing size to be bent to a pitch of any of 1×12, 2×12, 3×12 and 4×12. Second angle set channel 114 is used for any flashing size to be bent to a pitch of any of 5×12, 6×12, 7×12 and 8×12. Third angle set channel 116 is used for any flashing size to be bent to a pitch of any of 9×12, 10×12, 11×12 and 12×12. Each of the indicated pitches for the respective ones of the angle set channels 112-116 is achievable in view of the permitted tolerance for such pitches. Specifically, flashing that has been modified with the second bending tool 100, will be within about ⅛" of the designated pitch. The primary channel 110 and the angle set channels 112-116 may be cut into or molded into and through the second bending tool 100 plate.

The first angle set channel 112 is arranged with respect to the primary channel 110 such that the interior angle they form at vertex 118 is less than 90°. This is necessary to accommodate the relaxation of the flashing that is drawn through the first channel 112 of the angling channel 108 as described herein. That is, when the flashing exits the second bending tool 100 after being pulled through the primary channel 110 and the first channel 112, the resultant flashing pitch is suitable for any between 1×12 and 4×12.

The second angle set channel 114 is arranged with respect to the primary channel 110 such that the interior angle they form at vertex 118 is about 90°. This is necessary to accommodate the relaxation of the flashing that is drawn through the second channel 114 of the angling channel 108 as described herein. That is, when the flashing exits the second bending tool 100 after being pulled through the primary channel 110 and the second channel 114, the resultant flashing pitch is suitable for any between 5×12 and 8×12.

The third angle set channel 116 is arranged with respect to the primary channel 110 such that the interior angle they form at vertex 118 is greater than 90°. This is necessary to accommodate the relaxation of the flashing that is drawn through the third channel 116 of the angling channel 108 as described herein. That is, when the flashing exits the second bending tool 100 after being pulled through the primary channel 110 and the third channel 116, the resultant flashing pitch is suitable for any between 9×12 and 12×12.

With continuing reference to FIGS. 2-4, the second bending tool 100 includes a first flashing length restrictor 120 and a second flashing length restrictor 122. The first restrictor 120 includes a pivot end 124 that is removably affixable to the first surface of the second bending tool 100, and a swing arm 126 that is arranged to pivot about the pivot end 124. The second restrictor 122 includes a pivot end 128 that is removably affixable to the first surface of the second bending tool 100, and a swing arm 130 that is arranged to pivot about the pivot end 128. The second bending tool 100 includes a first restrictor port 132, a second restrictor port 134, a third restrictor port 136 and a secondary pivot pin 138 associated with the selectable positioning of the first restrictor 120, and a fourth restrictor port 140, a fifth restrictor port 142 and a sixth restrictor port 144 associated with the second restrictor 122.

The first restrictor 120 and the second restrictor 122 may be operated in tandem to establish the size of flashing to be bent. Specifically as shown in FIG. 2, the first restrictor 120 and the second restrictor 122 ale positioned so that the first restrictor 120 is spaced away from the angling channel 108 and the second restrictor 122 is spaced away from the primary channel 110. In this arrangement, a piece of 8" flashing may be inserted fully into the primary channel 108 and any of the angle set channels 112-116. This positioning of the first restrictor 120 is achieved by inserting position end 146 in second restrictor port 134 (shown in FIGS. 3 and 4). The positioning of the second restrictor 122 is achieved by inserting positioning end 148 in fourth restrictor port 140 (shown in FIGS. 3 and 4). The pivot end 124 of the first restrictor 120 may be secured in place such as by tightening a locking screw associated therewith. The pivot end 128 of the second restrictor 122 may be secured in place such as by tightening a locking screw associated therewith.

In order to bend 6" flashing, the first restrictor 120 and the second restrictor 122 are positioned as shown in FIG. 3. In this arrangement, the first restrictor 120 and the second restrictor 122 are positioned so that the first restrictor 120 extends across the angle set channels 112-116 and the second restrictor 122 extends across the primary channel 110. A piece of 6" flashing may be inserted into the primary channel 108 up to the second restrictor 122 at location 150, and into any of the angle set channels 112-116 up to the first restrictor 120 at location 152. This positioning of the first restrictor 120 is achieved by inserting position end 146 in first restrictor port 132 (shown in FIGS. 2 and 4). The positioning of the second restrictor 122 is achieved by inserting positioning end 148 in fifth restrictor port 142 (shown in FIGS. 2 and 4). The pivot end 124 of the first restrictor 120 may be secured in place such as by tightening a locking screw associated therewith. The pivot end 128 of the second restrictor 122 may be secured in place such as by tightening a locking screw associated therewith.

In order to bend 4.5" flashing, the first restrictor 120 and the second restrictor 122 are positioned as shown in FIG. 4. In this arrangement, the first restrictor 120 and the second restrictor 122 are positioned so that the first restrictor 120 extends across the angle set channels 112-116 and the second restrictor 122 extends across the primary channel 110. A piece of 4.5" flashing may be inserted into the primary channel 108 up to the second restrictor 122 at location 154, and into any of the angle set channels 112-116 up to the first restrictor 120 at location 156. This positioning of the first restrictor 120 is achieved by inserting position end 146 in third restrictor port 136 (shown in FIGS. 2 and 3), and securing pivot end 124 on secondary pivot pin 138. The positioning of the second restrictor 122 is achieved by inserting positioning end 148 in sixth restrictor port 144 (shown in FIGS. 2 and 3). The pivot end 124 of the first restrictor 120 may be secured in place such as by tightening a locking screw associated therewith. The pivot end 128 of the second restrictor 122 may be secured in place such as by tightening a locking screw associated therewith.

In use, a person interested in bending flashing to a pitch angle ranging from 1×12 to 12×12 coming out of the second bending tool 100, first positions the first restrictor 120 and the second restrictor 122 where indicated as described above in regard to the particular flashing size of interest. The user than inserts the leading edge of a flat piece of flashing into the starter slot 102-106 corresponding to the flashing size of interest until the flashing abuts terminal end 158 and bends the piece upwardly to contact tool side 160. That produces a crimp in a corner of the flashing piece about midway along the flashing width. The flashing piece is then removed from the starter slot selected.

Upon removal from the selected one of the starter slots 102-106, the user then inserts an edge thereof into a selectable one of angle set channels 112-116 of angling channel 108. The particular angle set channel selected is determined by the flashing pitch desired. The originating crimp is then inserted into the corner associated with vertex 118 such that a first "leg" of the flashing piece is located in the selected one of the angle set channels 112-116 and abuts either terminal end 162 for 8" flashing, location 152 for 6" flashing or location 156 for 4.5" flashing, dependent upon flashing size of interest. The second "leg" of the flashing piece, the one that was created at the leading edge by contacting contact side 160, is directed into primary channel 110 and abuts either terminal end 164 for 8" flashing, location 150 for 6" flashing or location 154 for 4.5" flashing, dependent upon flashing size of interest. Once the piece is positioned in the identified channels, the user pulls it through the second bending tool 100 for the entire selectable length of the piece. The piece produced is flashing arranged through its entire length at the selected pitch angle.

The flashing bender system of the present invention may include either or both of the first bending tool 10 and the second bending tool 100. The flashing bender system allows a user to bend flashing of a range of sizes at a range of angles over an unlimited length. The flashing bender system is a low cost system that allows a single user efficiently and accurately bend flashing on site. The present invention has been described with respect to specific features of the two tools. Nevertheless, it is to be understood that various modifications may be made without departing from the spirit and scope of the invention as described by the following claims.

What is claimed is:

1. A flashing bender system comprising:

a. a first bending tool for bending flashing at about 90°, the first bending tool including a plurality of starter slots and an angling section including a primary channel and a plurality of flashing size channels arranged in relation to the primary channel to bend flashing inserted therein; and b. a second bending tool for bending flashing at a pitch between 1×12 and 12×12, the second bending tool including a plurality of starter slots and an angling channel, wherein the angling channel includes a primary channel and a plurality of angle set channels arranged in relation to the primary channel of the second bending tool to enable bending of flashing of selectable size at a selectable pitch.

2. The flashing bender system of claim 1 wherein the second bending tool includes a first flashing length restrictor and a second flashing length restrictor, wherein the first flashing length restrictor is arranged for selectable positioning across the plurality of angle set channels and the second flashing length restrictor is arranged for selectable positioning across the primary channel of the second bending tool.

3. The flashing bender system of claim 1 wherein the first bending tool includes a second angling section arranged to bend step flashing.

4. The flashing bender system of claim 1 wherein the starter slots of the first bending tool include slots for 4.5", 6", 8" and 5"×7" flashing.

5. The flashing bender system of claim 1 wherein the starter slots of the second bending tool include slots for 4.5", 6" and 8" flashing.

6. The flashing bender system of claim 1 wherein the primary channel and the flashing size channels of the first bending tool are arranged in relation to one another to establish an internal angle therebetween that is less than 90°.

7. The flashing bender system of claim 1 wherein the plurality of angle set channels of the second bending tool include a first angle set channel, a second angle set channel and a third angle set channel, wherein the first angle set channel is arranged to enable bending of flashing to a pitch in the range 1×12 to 4×12, the second angle set channel is arranged to enable bending of flashing to a pitch in the range 5×12 to 8×12, and the third angle set channel is arranged to enable bending of flashing in the range 9×12 to 12×12.

8. A bending tool for bending flashing at a pitch between 1×12 and 12×12, the bending tool comprising:

a. a plurality of starter slots; and b. an angling channel, wherein the angling channel includes a primary channel and a plurality of angle set channels arranged in relation to the primary channel to enable bending of flashing of selectable size at a selectable pitch.

9. The bending tool of claim 8 further comprising a first flashing length restrictor and a second flashing length restrictor, wherein the first flashing length restrictor is arranged for selectable positioning across the plurality of angle set channels and the second flashing length restrictor is arranged for selectable positioning across the primary channel.

10. The bending tool of claim 8 wherein the starter slots include slots for 4.5", 6" and 8" flashing.

11. The bending tool of claim 8 wherein the plurality of angle set channels of the second bending tool include a first angle set channel, a second angle set channel and a third angle set channel, wherein the first angle set channel is arranged to enable bending of flashing to a pitch in the range 1×12 to 4×12, the second angle set channel is arranged to enable bending of flashing to a pitch in the range 5×12 to 8×12, and the third angle set channel is arranged to enable bending of flashing in the range 9×12 to 12×12.

* * * * *